US006964437B2

(12) United States Patent
Massotte et al.

(10) Patent No.: US 6,964,437 B2
(45) Date of Patent: Nov. 15, 2005

(54) PROCESS AND DEVICE FOR KNOTTING A YARN ON A SPOOL

(75) Inventors: Philippe Massotte, Gueberschwihr (FR); Hubert Liebmann, Wittelsheim (FR)

(73) Assignee: Superba (Societa Anonyme), Mulhouse (FR)

( * ) Notice: Subject to any disclaimer, the term of this patent is extended or adjusted under 35 U.S.C. 154(b) by 70 days.

(21) Appl. No.: 10/318,234

(22) Filed: Dec. 13, 2002

(65) Prior Publication Data

US 2003/0111841 A1 Jun. 19, 2003

Related U.S. Application Data

(60) Provisional application No. 60/345,646, filed on Jan. 8, 2002.

(30) Foreign Application Priority Data

Dec. 14, 2001 (FR) ..... 01 16253

(51) Int. Cl.[7] ..... B65H 69/04
(52) U.S. Cl. ..... 289/1.5; 289/2; 289/18.1
(58) Field of Search ..... 289/1.2, 1.5, 2, 289/17, 18.1; 57/266–275; 242/475.1, 475.4, 475.6, 475.7, 475.8, 476, 164

(56) References Cited

U.S. PATENT DOCUMENTS 3,110,450 A 11/1963 Raasch
3,595,491 A * 7/1971 Bourque ..... 242/475.7
4,084,767 A * 4/1978 Witt ..... 242/164
4,437,617 A * 3/1984 Cardell ..... 242/475.7
4,550,886 A * 11/1985 Fujiwara et al. ..... 242/476
5,332,170 A * 7/1994 Dittly ..... 242/475.8
5,356,085 A * 10/1994 Kobayashi et al. ..... 242/475.8
5,553,798 A * 9/1996 Kobayashi et al. ..... 242/475.8
6,419,283 B1 * 7/2002 Thomas et al. ..... 289/2

FOREIGN PATENT DOCUMENTS

| | | |
|---|---|---|
| DE | 187936 | 11/1906 |
| DE | 195 48 935 A1 | 7/1996 |
| EP | 0 885 830 A1 | 12/1998 |
| JP | 8-319062 | 12/1996 |

* cited by examiner

*Primary Examiner*—Gary L. Welch
(74) *Attorney, Agent, or Firm*—Young & Thompson

(57) ABSTRACT

The present invention relates to a process and device for knotting a yarn on a package. The process consists essentially in gripping the end (3) of the yarn and positioning the yarn under tension in prolongation of the last wound turn, in producing a slack loop parallel to the end (3) of the tensioned yarn, then in forming a twist by twisting a length of the slack loop with end (3) of the tensioned yarn, in then tightening the obtained twist on the package (1) and in cutting the remaining end of the yarn. The invention is more particularly applicable in the field of the textile industry, in particularly for the winding of yarns and particularly knotting an end of the yarn on a package.

19 Claims, 5 Drawing Sheets

PROCESS AND DEVICE FOR KNOTTING A YARN ON A SPOOL

BACKGROUND OF THE INVENTION

The present invention relates to the field of textile industry, in particular winding of filaments and especially knotting one end of a filament on a bobbin and has for its object a process for knotting a filament on a bobbin.

The invention also has for its object a device for practicing this process.

DESCRIPTION OF THE RELATED ART

The packaging of products in the form of filaments generally takes place on supports called bobbins. Such a bobbin is constituted by a series of layers of the product to be wound. At the end of winding, the end of the wound product must always be attached so as to avoid more or less great unwinding during ultimate handling of the bobbin, in particular during transport. This phenomenon of unwinding is the greater the more flexible is the wound product, in particular in the case of textile filaments.

At present, securing the free end of the filament is carried out in different ways, namely by the use of a film of synthetic material encircling the bobbin and pinching the end of the filament against the support or spool, by manual or automatic knotting of the end of the filament on itself, or else by inserting said end below the layers.

The processes for knotting the end, known until the present, however have a certain number of drawbacks. In the case of a sleeve, it is necessary to use a supplemental product such as a film, whilst in the case of catching the end in the support, the shape of the bobbin must be specially suited, such that it can thereafter be further used only for unwinding.

Knotting the end of the filament on itself involves a complicated knotting movement and a risk of slippage, particularly with slippery filaments.

Finally, during insertion of the end below the layers, this gripping is limited by the hardness of the bobbins and fragile filaments risk being broken.

SUMMARY OF THE INVENTION

The present invention has for its object to overcome these drawbacks by providing a process of knotting a filament on a bobbin and a device for practicing this process, permitting automatic and universal hooking of the end of a filament on a bobbin, no matter what the type of support, or filaments or hardness of the bobbin, whilst guaranteeing reliable knotting and easy unknotting, during subsequent use.

To this end, the process of knotting a filament on a bobbin, according to the invention, is characterized in that it consists essentially in grasping the end of the filament and in positioning said filament under tension in prolongation of the last wound turn, in forming a slack loop parallel to the end of the tensioned filament, then forming a twist by twisting a length of the slack loop with the end of the tension filament, and then tightening the obtained twist on the bobbin and cutting the remaining end of the filament.

The invention also has for its object a device for practicing this process, characterized in that it is essentially constituted by a device for gripping and positioning the end of the unwound filament, by means for forming a slack loop, by a device for forming a twist and by means for cutting the remaining end of the filament.

BRIEF DESCRIPTION OF THE DRAWINGS

The invention will be better understood from the following description, which relates to a preferred embodiment, given by way of non-limiting example and explained with reference to the accompanying schematic drawings, in which.

DESCRIPTION OF THE PREFERRED EMBODIMENTS

Figure 1:
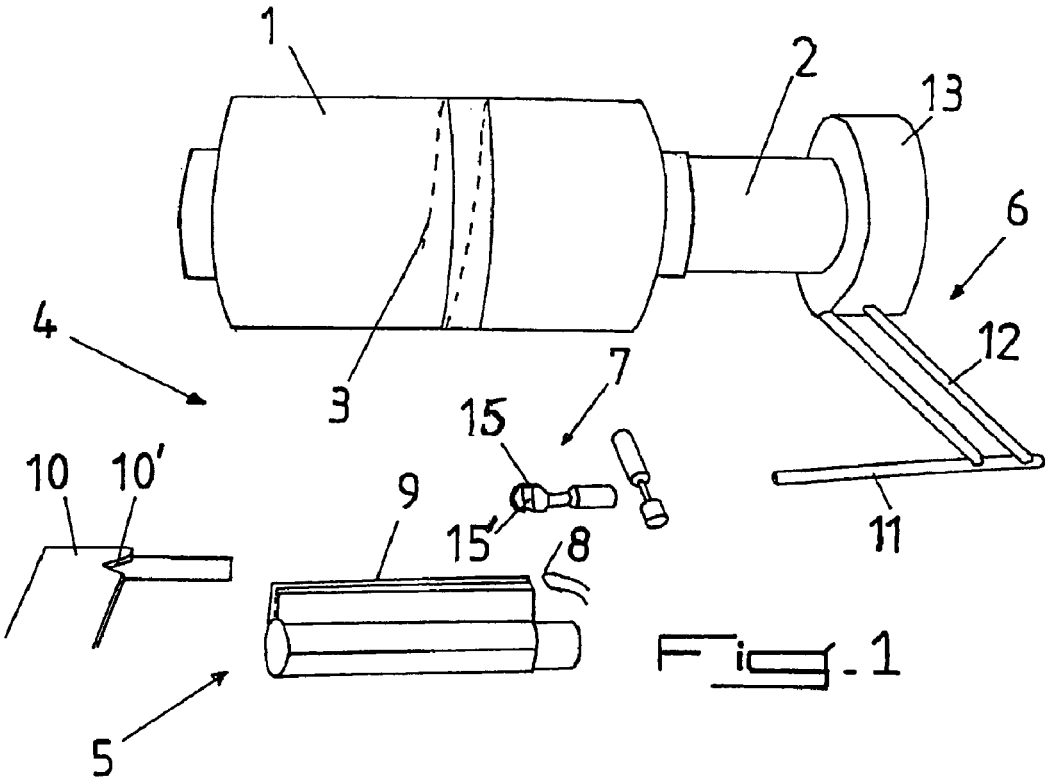
FIG. 1 is a schematic perspective view of a device for practicing the process according to the invention.

FIGS. 1 to 5, 8 and 9 of the accompanying drawings show a bobbin of filament 1 mounted on a rotatable support 2 and having a free end 3 located arbitrarily on the periphery of the bobbin 1, the machine comprising this rotatable support 2 being moreover provided with a device 4 for knotting a filament on a bobbin. In the illustrated embodiment, the bobbin 1 is mounted on a support in the form of a mandrel. However, it is also possible to mount the bobbin 1 on a different support, this support being simply capable of turning in both directions of rotation.

According to the invention, the device 4 for knotting a filament uses a knotting process, which consists essentially in grasping the end 3 of the filament and in positioning said filament under tension in prolongation of the last wound turn, in producing a slack loop parallel to the end 3 of the tensioned filament, then in forming a twist by twisting a length of the slack loop with the end of the tensioned filament, and then tightening the obtained twist on the bobbin and in cutting the remaining end of the filament.

Figure 2:
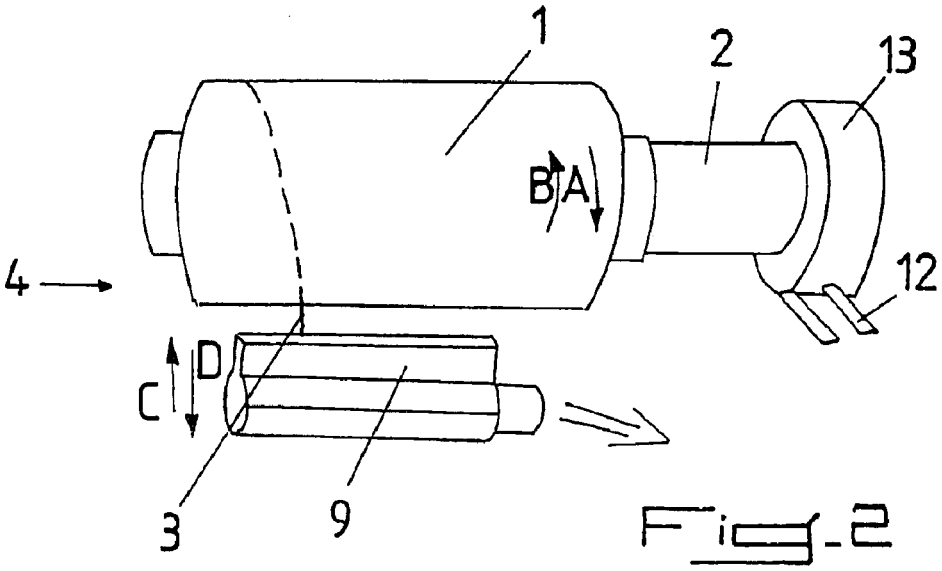
FIGS. 2 to 9 are fragmentary perspective views showing different phases of the knotting.
Figure 3:
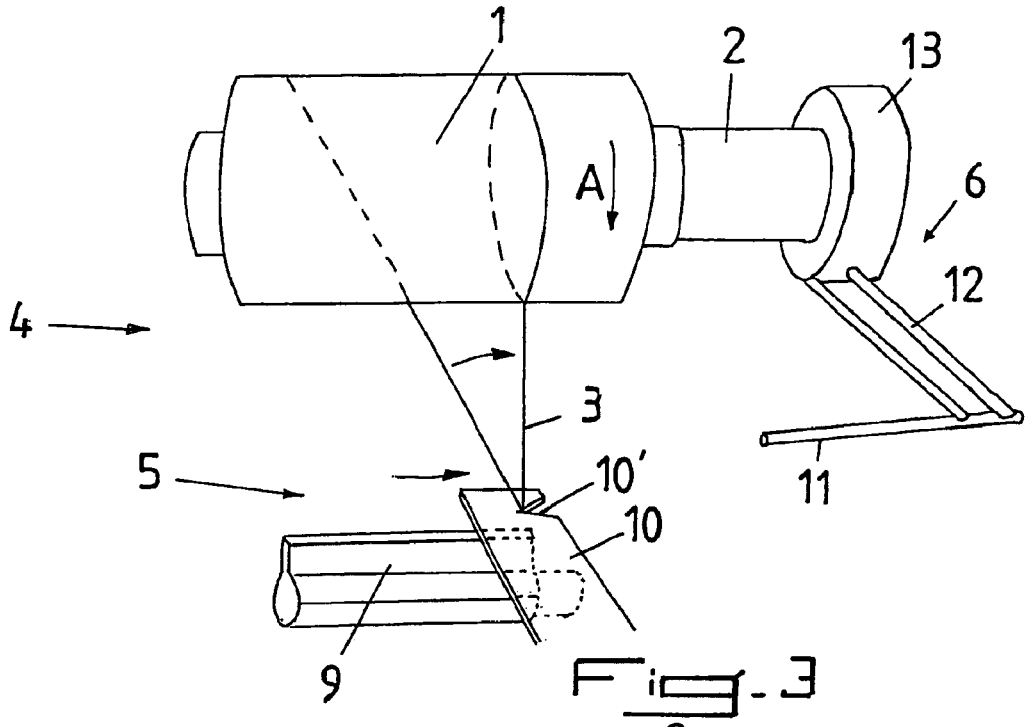

According to a first manner of carrying out the invention shown in the accompanying drawings, the grasping of the end 3 of the filament and its positioning under tension in prolongation of the last wound turn, are carried out by suction of said end 3 and rotating to unwind the filament from the bobbin 1 by the support 2, with simultaneous production of a predetermined length of tensioned filament, then by movement of the length of tensioned filament transversely to the longitudinal axis of the bobbin 1 and by partial rewinding of the filament to obtain a straight turn aligned with the tensioned filament (FIGS. 2 and 3). To this end, a predetermined length of filament, corresponding to a predetermined number of turns of unwinding rotation of the bobbin 1, that can easily be calculated, is unwound and taken up by suction. In the course of suction or at the end of this latter, there is provided a space in which the filament is tensioned and into which can penetrate a deflection means of the filament at the end of suctioning, such that this latter can be brought under tension in a position inclined transversely relative to the longitudinal axis of the bobbin 1 (FIG. 3). During subsequent rewinding, the filament thus held rolls up to produce a straight turn (FIG. 3).

Figure 4:
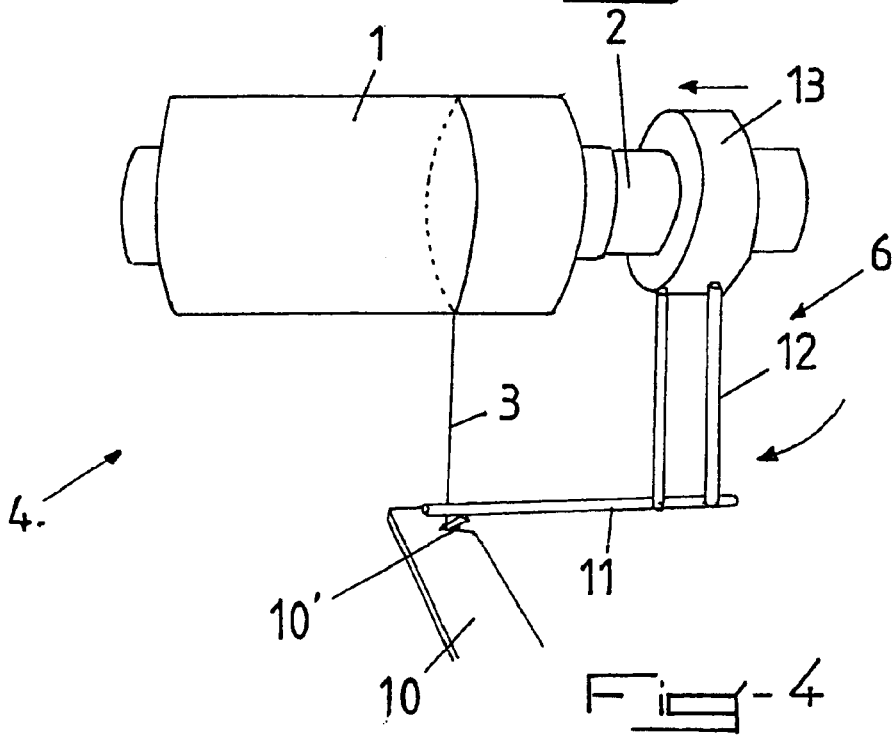
Figure 5:
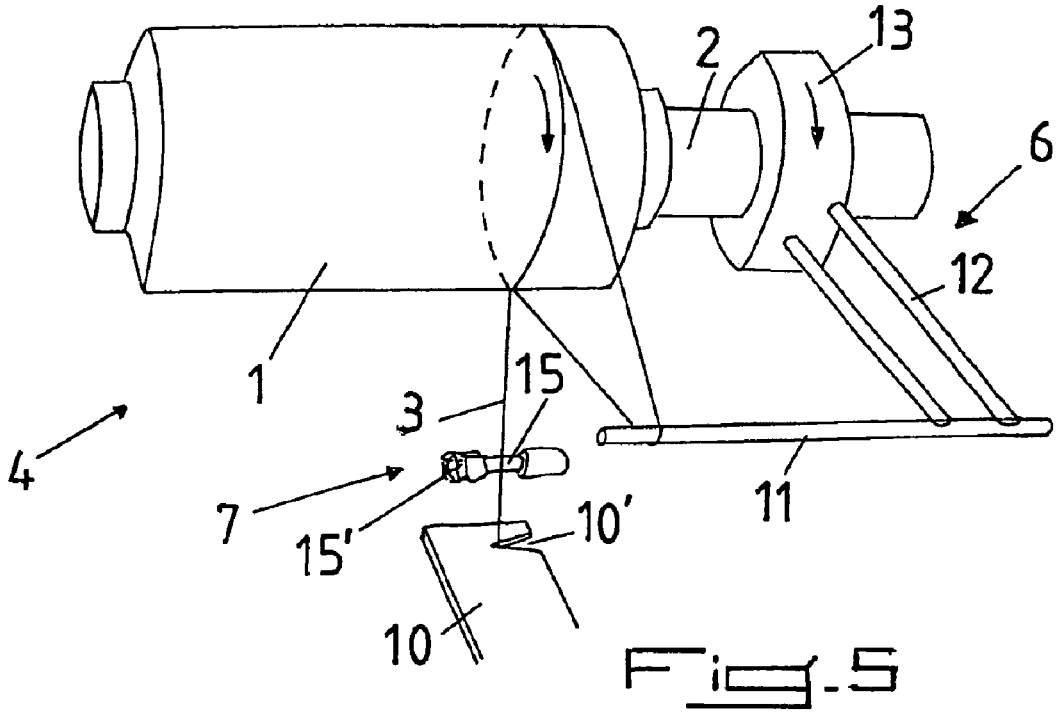

The production of the slack loop, parallel to the end 3 of the tensioned filament, is carried out by formation of a turn of a circumference substantially greater than that of the turns of the bobbin 1, in the direction of rotation of winding, with maintenance under tension of the free end 3 of the filament. This formation of the slack loop can be carried out with traction on the free end 3 of the filament and simultaneous rotation of the bobbin 1 and of a pressure means deflected relative to the maximum diameter of the bobbin 1, in the direction of winding, as shown in FIGS. 4 and 5 of the accompanying drawings. Thus, a portion of the filament tensioned by aspiration is rewound on the bobbin 1 by forming a loop or turn of a diameter greater than that of the turns previously wound, this loop coming into position with one of its lengths, after a rotation of one turn, beside the end 3 of the tensioned filament.

According to a modified embodiment of the invention, not shown in the accompanying drawings, the formation of the slack loop can also be carried out by pressure means deflected relative to the maximum diameter of the bobbin 1, moving about the bobbin 1 in the direction of winding, the end 3 of the tensioned filament being held securely and the bobbin 1 being maintained in free rotation on the support 2, the loose loop or turn of greatest circumference being obtained by corresponding partial unwinding from the bobbin 1, under traction. In such a case, the movement of the pressure means deflected relative to the maximum diameter of the bottom of the bobbin 1 causes traction on the wound up filament having the effect of causing a corresponding partial unwinding of the bobbin 1 during movement of the deflected pressure means and its passage over the generatrix of this latter. Thus, the slack loop or turn of greatest diameter is made by traction on a wound turn and elongation of this turn by corresponding partial unwinding.

Figure 6:
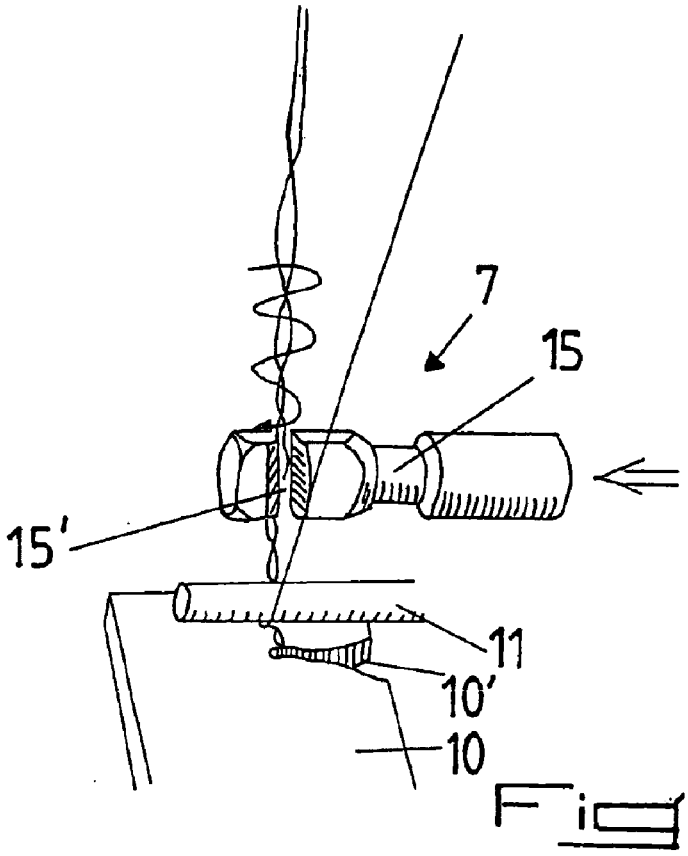
Figure 7:
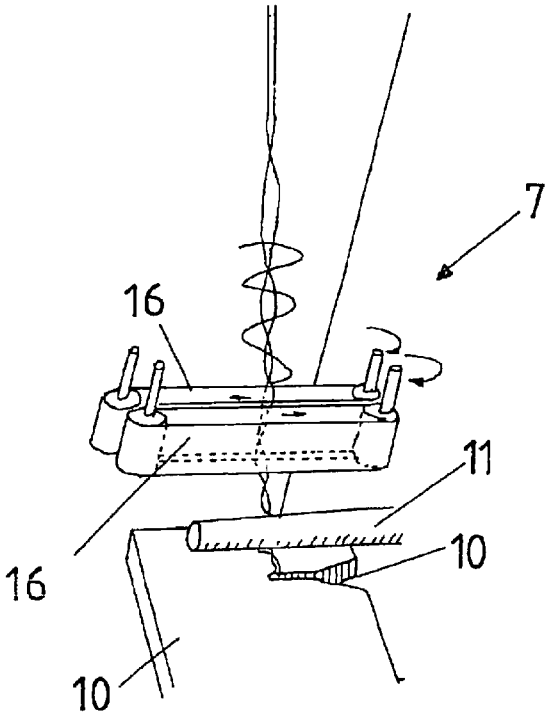
Figure 8:
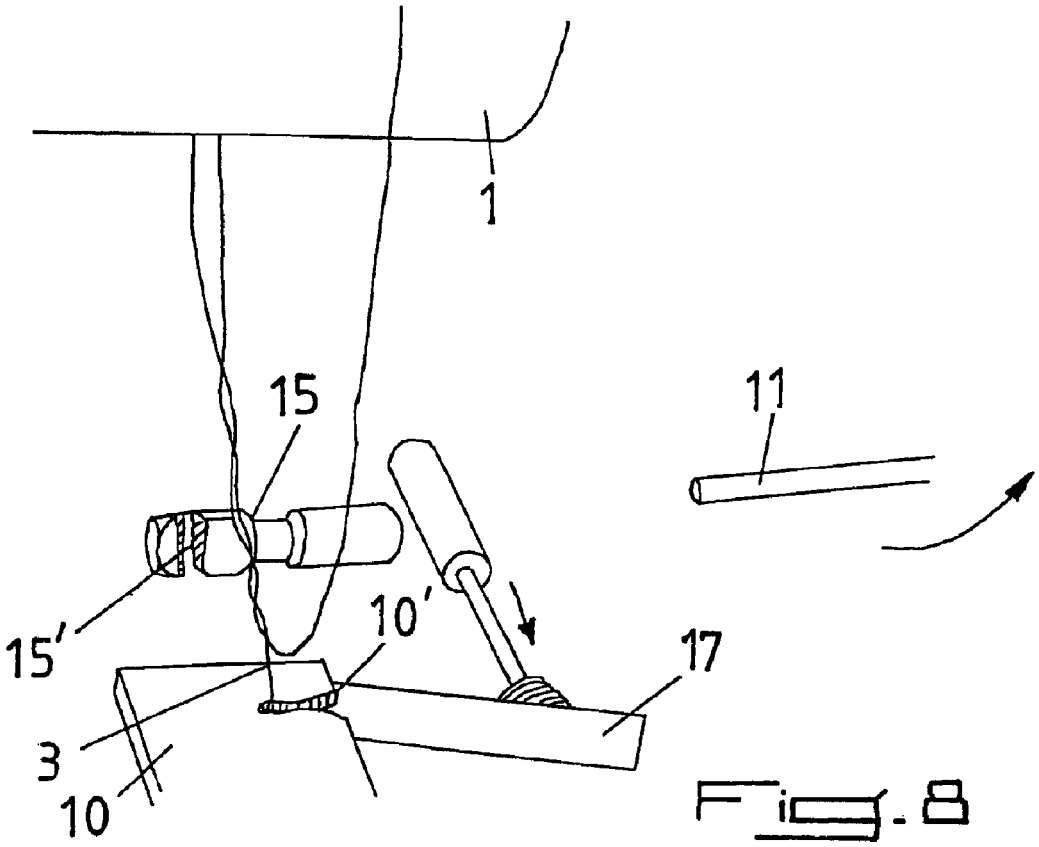

The formation of the twist by twisting takes place by simultaneous gripping of a length of the slack loop and of the end 3 of the tensioned filament, followed by mechanical or pneumatic movement of rotation of the length of the loop about the end 3 of the tensioned filament (FIGS. 6 and 7). This formation of the twist consists in fact in providing a twist of a length of the slack loop on the end 3 of the tensioned filament, such that they remain intimately connected.

Figure 9:
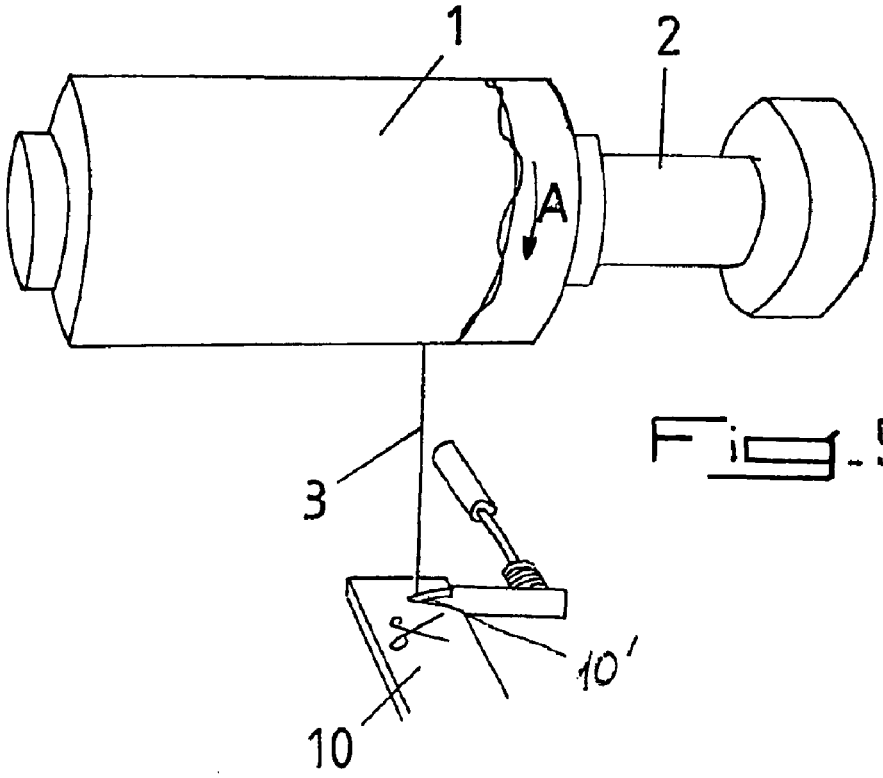

The tightening of the twist obtained on the bobbin 1 is effected, as shown particularly in FIG. 9 of the accompanying drawings, by a tractive action on the end 3 of the tensioned filament under the effect of rotation of the bobbin 1 in the winding direction and holding stationary said end 3 of the tensioned filament or under the effect of direct traction on said end 3 of the tensioned filament. Such a traction has the effect of forming a slight knot in the last turn of filament on the bobbin 1, by reduction of the circumference of the loose loop and simultaneous coaction of a length of this latter with the end 3 of the tensioned filament. In the case in which the end 3 of the tensioned filament is subject to direct traction, said end is pulled in a direction opposite to the bobbin 1, this latter being held stationary, such that the reduction effect previously described is also obtained.

Cutting the remaining end of the filament, after knotting, is carried out according to known processes by mechanical or thermal action.

The device 4 for knotting a filament for practicing this process is essentially constituted by a device 5 for gripping and positioning the free end 3 of the wound up filament, by a means 6 for forming a slack loop, by a device 7 for forming a twist and by means 8 for cutting the remaining end 3 of the filament.

According to a preferred embodiment of the invention, shown in FIGS. 1 to 3 of the accompanying drawings, the device 5 for gripping and positioning the free end 3 of the wound up filament is preferably constituted by a suction nozzle 9, provided with a cell (not shown) for detecting the filament and movable toward and away from the bobbin 1 in a plane passing through the longitudinal axis of this latter and by a positioning plate 10 movable from a position outside the longitudinal profile of the bobbin 1, parallel to the longitudinal axis of said bobbin 1 and provided with a notch 10' for indexing the filament sucked by the nozzle 9. Preferably, the suction nozzle 9 is provided inside a permeable retaining element such as a fine grill or a sheet of foam, adapted to retain the sucked end of the filament 3. Thus, the filament sucked by the nozzle 9 can be disposed within this latter by avoiding being subjected to an effect of untwisting due to the suction. As a result, the end of the filament remains completely in the condition during rewinding or subsequent use.

The location of the free end 3 of the filament is carried out by movement of the suction nozzle 9 with a movement C (FIG. 2) toward the surface of the bobbin 1 which turns on itself in direction A for unwinding the filament until the free end 3 of the wound up filament is detected by the detection cell of the suction nozzle 9. This cell then triggers a reversal of the direction of rotation of the bobbin 1 by means of the support 2, in the direction B, so as to unwind the filament, which can be sucked by the nozzle 9. This latter then moves away in the direction D from the bobbin 1, whilst remaining in operation, when a predetermined length of filament is sucked. The sucked filament is thus present under tension between the bobbin 1 and the nozzle 9 (FIG. 2).

The positioning plate 10 is then moved parallel to the longitudinal axis of the bobbin 1, so as to cross the end 3 of the tensioned filament between said bobbin 1 and the suction nozzle 9, the filament positioning itself automatically in the indexing knot 10'. This movement of the positioning plate 10 has the result of bringing the filament into an inclined position relative to a line perpendicular to the bobbin 1. This latter is then rotated in the winding direction by the support 2, which causes a positioning of the filament perpendicularly to the bobbin 1 and the production of at least one straight turn aligned with the tensioned filament (FIG. 3).

The means 6 for forming a slack loop is preferably present in the form of a retractable abutment 11 mounted by means of a pivoting frame 12 actuated by a jack (not shown), on a rotating sleeve 13 coaxial to the bobbin 1 and driven in rotation in a clutchable manner. The driving in rotation of the sleeve 13 can preferably be carried out by means of an independent motor (not shown) or else by means of a clutching device (not shown) coacting with the rotational drive of the bobbin 1. So as to permit complete disengagement of the retractable abutment 11 in the rest position, the rotatable sleeve 13 is preferably mounted slidably coaxially to the bobbin 1 and is actuated in sliding movement by means of a jack (not shown). Moreover, to ensure perfect disengagement of the retractable abutment 11 after forming the slack loop, the frame 12 is preferably present in the form of a parallelogram, whose large side opposite the corresponding end of the bobbin is slightly longer than the one articulated with the small side carrying the retractable abutment 11.

According to a first embodiment of the invention, the retractable abutment 11 is preferably mounted coaxially on a mandrel 14 for reception of and driving in rotation the bobbin 1 (FIGS. 1 to 5).

Thus, for the formation of the slack loop in the form of a turn of a circumference substantially greater than that of the turns on the bobbin 1, after stopping the winding of at least one straight turn in prolongation of the free end of the filament 3, the retractable abutment is moved in front of said tensioned filament by suction of the nozzle. To this end, the frame 12 carrying the abutment 11 is first moved by coaxial sliding in the direction of the bobbin 1, then it is actuated by the corresponding jack in the direction of pivoting of the abutment 11 in front of the tensioned filament, in line with the indexing notched and prime (FIG. 4).

As shown in FIG. 5 of the accompanying drawings, the slack loop is thus formed by simultaneous rotation of the bobbin 1 and of the retractable abutment 11 about the longitudinal axis of the bobbin 1. As a result, a portion of the filament tensioned by aspiration is rewound on the bobbin 1 by forming a loop or turn of a diameter greater than that of the turns previously wound, this loop coming into place with one of its lengths, after rotation of one turn, beside the end 3 of the tensioned filament. This formation of the slack loop takes place by pulling on the tensioned filament by suction.

According to a modified embodiment of the invention, not shown in the accompanying drawings, the means 6 for producing a slack loop can also be present in the form of a retractable abutment independent of the drive of the bobbin 1 and whose axis of rotation is coaxial to that of the bobbin 1, said retractable abutment being guided along an elliptical path. Such a mode of production can, particularly, be adapted to an application of the device to a winding frame, the retractable abutment being then driven by specific means and guided laterally to the winding station. Thus, it suffices, at the end of winding, to produce several straight turns by stopping the movement of the winding machine flyer and by pinching the filament at the level of said flyer upon stopping the winding cylinder, the emplacement of the retractable abutment before the tensioned filament and the consecutive movement of said abutment along its elliptical trajectory having the effect of permitting the formation of the slack loop with traction on the filament maintained under tension by pinching. As a result, the formation of the loop takes place with slight unwinding of the filament previously wound in straight turns, the drive of the bobbin 1 being then disengaged.

The device 7 for forming a twist can be constituted, according to a first embodiment of the invention shown in FIG. 6 of the accompanying drawings, by an air nozzle 15 with an open channel 15' having a reception chamber for a portion of the tensioned filament 3 and a corresponding parallel portion of a length of the slack loop.

FIG. 7 of the accompanying drawings shows a modified embodiment of the device 7 for formation of a twist, in which this device is constituted by a mechanical assembly with friction comprising two bands 16 moving in opposite directions and pressed on opposite sides of the assembly formed by the end of the tensioned filament and by the corresponding length of the slack loop.

In the case of the use of an air nozzle 15 according to FIG. 6, an injection of air under pressure into said nozzle, for a predetermined time, permits creating an intermingling of the two portions of parallel filaments, by twisting. The use of a mechanical assembly with friction (FIG. 7) permits achieving the same result. It follows that the free end 3 of the tensioned filament is intimately connected to a corresponding portion of the slack loop.

The tightening of the obtained twist or knotting of the end of the filament on the bobbin 1 is simply carried out by traction on said end of the filament held by a filament grip 17 in the notch 10' of the plate 10, said traction being generated by rotation of the bobbin 1 in the rewinding direction. It is also possible to produce traction on the filament by braking the bobbin 1 with its drive means, the end of the filament 3 then being subject to movement in a direction contrary to the direction of winding, for example by impression of a retraction movement on the unwound filament in a winding frame. This traction on the filament on the tensioned end of the filament has the effect of producing a knot in said filament about the bobbin 1, which knot has sufficient consistency to avoid untimely unwinding of the filaments during operations of transportation or handling.

The means 8 for cutting the remaining end 3 of the filament can be constituted by any existing devices, mechanical or thermal for sectioning filaments and is not described in greater detail.

Thanks to the invention, it is possible to provide an automatic gripping of a free end of a bobbin filament on a bobbin, no matter what the type of support for the filament or the hardness of the bobbin, whilst guaranteeing reliability or optimum solidity as to the point of gripping and by maintaining the possibility of easily undoing the obtained knot during use of the wound product, by simple traction on the free end.

Of course, the invention is not limited to the embodiment described and shown in the accompanying drawings. Modifications remain possible, particularly as to the construction of the various elements or by substitution of technical equivalents, without thereby departing from the scope of protection of the invention.

What is claimed:

1. Process for knotting a yarn on a package characterized in that it consists essentially in gripping the end (3) of the yarn and in positioning said yarn under tension in prolongation of the last wound turn, in forming a slack loop parallel to the end (3) of said tensioned yarn, then in forming a twist by twisting a length of the slack loop with the end (3) of the tensioned yarn, in then tightening the obtained twist on the package (1) and in cutting the remaining end of the yarn.

2. Process according to claim 1, characterized in that the gripping of the end (3) of the yarn and its position under tension in prolongation of the last wound turn, are carried out by suction of said end (3) and unwinding rotation of the yarn from the package (1) by the support (2), with simultaneous production of a predetermined length of tensioned yarn, then by movement of the length of tensioned yarn transversely to the longitudinal axis of the package (1) and by partial rewinding of the yarn for obtaining a straight turn aligned with the tensioned yarn.

3. Process according to claim 1, characterized in that in the course of sucking or at the end of this latter, there is provided a space in which the yarn is stretched and into which can penetrate a means for deflecting the yarn at the end of suction, such that this latter can be brought under tension into a position inclined transversely relative to the longitudinal axis of the package (1).

4. Process according to claim 1, characterized in that, during rewinding of the yarn subsequent to the end of sucking, the held yarn winds up to produce a straight turn.

5. Process according to claim 1, characterized in that the production of the slack loop, parallel to the end (3) of the tensioned yarn, takes place by formation of a turn of a circumference substantially greater than that of the turns of the package (1), in the direction of rotation of winding, with maintaining the free end (3) of the yarn under tension.

6. Process according to claim 5, characterized in that the formation of the slack loop is effected with traction on the free end (3) of the yarn and simultaneous rotation of the package (1) and by pressure means located beyond to the maximum diameter of the package (1), in the direction of winding.

7. Process according to claim 1, characterized in that the formation of the slack loop is effected by pressure means located beyond to the maximum diameter of the package (1), moving about the package (1) in the winding direction, the end (3) of the tensioned yarn being held securely and the package (1) being maintained in free rotation on the support (2), the slack loop or turn of greatest circumference being obtained by corresponding partial unwinding of the package (1) under traction.

8. Process according to claim 1, characterized in that the formation of the twist by twisting takes place by simultaneous gripping of a length of the slack loop and of the end (3) of the tensioned yarn, followed by mechanically or pneumatically causing a movement of rotation of the length of the loop about the end (3) of the tensioned yarn.

9. Process according to claim 1, characterized in that the tensioning of the obtained twist on the package (1) is effected by an action of traction on the end (3) of the tensioned yarn under the influence of rotation of the package (1) in the winding direction and holding stationary said end (3) of the tensioned yarn or under the influence of direct traction on said end (3) of the tensioned yarn.

10. Device for practicing a process according to claim 1, comprising:

a gripping device (5) for gripping and positioning the end (3) of the wound up yarn, a loop means (6) for producing a slack loop, a device (7) for forming a twist, and a cutting means (8) for cutting the remaining end (3) of the yarn.

11. Device according to claim 10, characterized in that the loop means (6) for producing a slack loop is a retractable abutment (11) mounted by a pivoting frame (12) actuated by a jack, on a rotatable sleeve (13) coaxial to the package (1) and driven in rotation in a disengageable manner.

12. Device according to claim 11, characterized in that the drive in rotation of the sleeve (13) is carried out by one of an independent motor and a clutching device coacting with the driving in rotation of the package (1).

13. Device according to claim 11, characterized in that the rotatable sleeve (13) is mounted slidably coaxially to the package (1) and is actuated in sliding movement by means of a jack.

14. Device according to claim 11, characterized in that the frame (12) is present in the form of a parallelogram, whose large side opposite the corresponding end of the package is slightly longer than that articulated with the small side carrying the retractable abutment (11).

15. Device according to claim 10, characterized in that the loop means (6) for producing a slack loop is a retractable abutment independent of the drive of the package (1) with an axis of rotation is coaxial to the axis of rotation of the package (1), said retractable abutment being guided along an elliptical path.

16. Device according to claim 10, characterized in that the twist device (7) for formation of a twist is constituted by an air nozzle (15) with an open channel (15') having a chamber for reception of a portion of the tensioned yarn (3) and of a corresponding parallel portion of a length of the slack loop.

17. Device for knotting a yarn on a package (1) by gripping an end (3) of the yarn and positioning the yarn under tension in prolongation of a last wound turn to form a slack loop parallel to the end (3) of the tensioned yarn, next forming a twist by twisting a length of the slack loop with the end (3) of the tensioned yarn, and then tightening the obtained twist on the package (1) and cutting a remaining end of the yarn, the device comprising:

a gripping device (5) for gripping and positioning the end (3) of the wound up yarn;

a loop means (6) for producing a slack loop;

a twist device (7) for forming a twist; and a cutting means (8) for cutting the remaining end (3) of the yarn, the gripping device (5) comprising a suction nozzle (9) provided with a cell for detecting the yarn and movable toward and away from the package (1) in a plane passing through the longitudinal axis of the package (1) and a positioning plate (10) movable from a position outside the longitudinal profile of the package (1) parallel to the longitudinal axis of said package (1) and provided with a notch (10') for indexing the yarn sucked by the nozzle (9), wherein, the suction nozzle (9) is provided internally with a permeable retention element adapted to retain the sucked end of the yarn (3).

18. The device of claim 17, wherein the permeable retention element is one of a fine grille and a sheet of foam.

19. Device for knotting a yarn on a package (1) by gripping an end (3) of the yarn and positioning the yarn under tension in prolongation of a last wound turn to form a slack loop parallel to the end (3) of the tensioned yarn, next forming a twist by twisting a length of the slack loop with the end (3) of the tensioned yarn, and then tightening the obtained twist on the package (1) and cutting a remaining end of the yarn, the device comprising:

a gripping device (5) for gripping and positioning the end (3) of the wound up yarn;

a loop means (6) for producing a slack loop;

a twist device (7) for forming a twist; and a cutting means (8) for cutting the remaining end (3) of the yarn, wherein, the twist device (7) for forming a twist is a mechanical friction assembly comprising two bands (16) that move in opposite directions and are pressed on opposite sides of the assembly formed by the end of the tensioned yarn (3) and by the corresponding length of the slack loop.

* * * * *